US010619632B2

(12) United States Patent
Kondo et al.

(10) Patent No.: US 10,619,632 B2
(45) Date of Patent: Apr. 14, 2020

(54) HYDRAULIC DRIVE SYSTEM OF CONSTRUCTION MACHINE

(71) Applicant: KAWASAKI JUKOGYO KABUSHIKI KAISHA, Kobe-shi, Hyogo (JP)

(72) Inventors: Akihiro Kondo, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/344,921

(22) PCT Filed: Sep. 29, 2017

(86) PCT No.: PCT/JP2017/035546
§ 371 (c)(1),
(2) Date: Apr. 25, 2019

(87) PCT Pub. No.: WO2018/079193
PCT Pub. Date: May 3, 2018

(65) Prior Publication Data

US 2019/0257304 A1 Aug. 22, 2019

(30) Foreign Application Priority Data

Oct. 25, 2016 (JP) ..... 2016-208724

(51) Int. Cl.
*F04B 49/06* (2006.01)
*E02F 9/22* (2006.01)
(Continued)

(52) U.S. Cl.
CPC ..... *F04B 49/06* (2013.01); *E02F 9/20* (2013.01); *E02F 9/22* (2013.01); *E02F 9/2221* (2013.01);
(Continued)

(58) Field of Classification Search
CPC ..... F04B 49/06; F04B 49/22; F04B 1/295; F04B 49/002; F15B 2211/6346;
(Continued)

(56) References Cited

U.S. PATENT DOCUMENTS 5,101,629 A * 4/1992 Sugiyama ..... E02F 9/2221 60/459
8,818,651 B2 * 8/2014 Joung ..... E02F 9/2235 701/50
(Continued)

FOREIGN PATENT DOCUMENTS

JP 2014-125774 A 7/2014

*Primary Examiner* — Abiy Teka
(74) *Attorney, Agent, or Firm* — Oliff PLC

(57) ABSTRACT

A variable displacement pump supplies hydraulic oil to turning motor via a turning control valve; pair of supply/discharge lines connect turning motor and turning control valve; a pair of make-up lines connect pair of supply/discharge lines to tank, each line having check valve; turning operation device including operating lever and outputting operation signal corresponding to inclination angle of operating lever; a flow rate adjuster adjusts tilting angle of pump; and controller controls flow rate adjuster, such that tilting angle of pump increases in accordance with increase in operation signal outputted from turning operation device. Controller: turning acceleration and at time of constant speed turning, controls flow rate adjuster such that discharge flow rate of pump changes on first regulation line; turning deceleration, controls flow rate adjuster such that discharge flow rate of pump changes on second regulation line, second regulation line having slope less than slope of first regulation line.

5 Claims, 8 Drawing Sheets

(51) Int. Cl.

| | |
|---|---|
| ***F15B 11/02*** | (2006.01) |
| ***E02F 9/20*** | (2006.01) |
| ***F15B 11/00*** | (2006.01) |
| ***F04B 49/00*** | (2006.01) |
| ***F04B 1/295*** | (2020.01) |
| ***F04B 49/22*** | (2006.01) |

(52) U.S. Cl.
CPC ..... *F04B 1/295* (2013.01); *F04B 49/002* (2013.01); *F04B 49/22* (2013.01); *F15B 11/00* (2013.01); *F15B 11/02* (2013.01)

(58) Field of Classification Search
CPC ... F15B 2211/6654; F15B 11/00; F15B 11/02; E02F 9/20; E02F 9/2221; E02F 9/22
See application file for complete search history.

(56) References Cited

U.S. PATENT DOCUMENTS

| | | | | |
|---|---|---|---|---|
| 2013/0160439 | A1* | 6/2013 | Lee ..... | E02F 9/2235 60/384 |
| 2013/0263583 | A1* | 10/2013 | Shin ..... | E02F 9/2235 60/327 |
| 2014/0178167 | A1 | 6/2014 | Goto et al. | |

* cited by examiner

HYDRAULIC DRIVE SYSTEM OF CONSTRUCTION MACHINE

TECHNICAL FIELD

The present invention relates to a hydraulic drive system of a construction machine.

BACKGROUND ART

Construction machines, such as hydraulic excavators and hydraulic cranes, perform various work by means of a hydraulic drive system. For example, Patent Literature 1 discloses a hydraulic drive system in which hydraulic oil is supplied from a variable displacement pump to a turning motor via a turning control valve.

To be specific, in the hydraulic drive system disclosed in Patent Literature 1, the turning motor is connected to the turning control valve by a pair of supply/discharge lines. The turning control valve includes a pair of pilot ports that are connected to a turning operation device by a pair of pilot lines. The turning operation device is a pilot operation valve that outputs a pilot pressure corresponding to the inclination angle of an operating lever to the turning control valve.

The tilting angle of the pump is adjusted by a flow rate adjuster (in Patent Literature 1, a regulator 15*a*). The flow rate adjuster is controlled by a controller, such that the tilting angle of the pump increases in accordance with increase in the pilot pressure outputted from the turning operation valve.

CITATION LIST

Patent Literature

PTL 1: Japanese Laid-Open Patent Application Publication No. 2014-125774

SUMMARY OF INVENTION

Technical Problem

When turning is stopped suddenly, since the turning control valve is returned to its neutral position immediately, the hydraulic oil discharged from the turning motor is blocked by the turning control valve, and thereby the pressure increases immediately. Consequently, one of relief valves provided on relief lines that branch off from the pair of supply/discharge lines functions as a brake. On the other hand, at a time when the speed of turning is lowered gradually (hereinafter, "at the time of gradual turning deceleration"), the opening area at the meter-out side of the turning control valve functions as a restrictor for the hydraulic oil returned from the turning motor to the tank, and thereby a brake is applied.

However, even at the time of gradual turning deceleration, the discharge flow rate of the pump is adjusted by the flow rate adjuster to a flow rate corresponding to the inclination angle of the operating lever of the turning operation device. That is, even though no energy for rotating the turning motor is required, a large amount of energy is consumed for driving the pump.

In view of the above, an object of the present invention is to provide a hydraulic drive system of a construction machine, the hydraulic drive system being capable of reducing energy consumption at the time of gradual turning deceleration.

Solution to Problem

In order to solve the above-described problems, a hydraulic drive system of a construction machine according to the present invention includes: a variable displacement pump that supplies hydraulic oil to a turning motor via a turning control valve; a pair of supply/discharge lines that connect the turning motor and the turning control valve; a pair of make-up lines that connect the pair of supply/discharge lines to a tank, respectively, each make-up line being provided with a check valve that allows a flow from the tank to a corresponding one of the supply/discharge lines and blocks a reverse flow; a turning operation device including an operating lever and outputting an operation signal corresponding to an inclination angle of the operating lever; a flow rate adjuster that adjusts a tilting angle of the pump; and a controller that controls the flow rate adjuster, such that the tilting angle of the pump increases in accordance with increase in the operation signal outputted from the turning operation device. The controller: when the operation signal outputted from the turning operation device increases and when the operation signal outputted from the turning operation device is constant, controls the flow rate adjuster such that a discharge flow rate of the pump changes on a first regulation line; and when the operation signal outputted from the turning operation device decreases, controls the flow rate adjuster such that the discharge flow rate of the pump changes on a second regulation line, the second regulation line having a slope less than a slope of the first regulation line.

According to the above configuration, the discharge flow rate of the pump is kept low at the time of turning deceleration, including at the time of gradual turning deceleration. Even when the discharge flow rate of the pump is insufficient as a necessary flow rate for rotating the turning motor, the shortfall amount of hydraulic oil is supplied to the turning motor through the make-up line. Thus, at the time of gradual turning deceleration, energy consumption can be reduced by an amount corresponding to the lowering of the discharge flow rate of the pump.

For example, the flow rate adjuster may include: a flow rate adjusting piston that operates a servo piston via a spool, such that the tilting angle of the pump increases in accordance with increase in a signal pressure; and a solenoid proportional valve of a direct proportional type, the solenoid proportional valve being fed with a command current from the controller and outputting a secondary pressure as the signal pressure. The controller may store a first sloped line and a second sloped line as relationship lines, the second sloped line having a slope less than a slope of the first sloped line, the relationship lines each indicating a relationship between the operation signal outputted from the turning operation device and the command current. The controller may: when the operation signal outputted from the turning operation device increases and when the operation signal outputted from the turning operation device is constant, determine the command current by using the first sloped line; and when the operation signal outputted from the turning operation device decreases, determine the command current by using the second sloped line.

The construction machine may be a hydraulic excavator. The pump may be a first pump. The turning control valve may be connected to the first pump by a pump line and connected to the tank by a tank line. The hydraulic drive system may further include: an arm first control valve connected to the first pump by a pump line and connected to the tank by a tank line; a second pump that is a variable displacement pump; an arm second control valve connected to the second pump by a pump line and connected to the tank by a tank line; a pair of first solenoid proportional valves connected to a pair of pilot ports of the arm first control valve; a pair of second solenoid proportional valves connected to a pair of pilot ports of the arm second control valve; and an arm operation device including an operating lever and outputting an operation signal corresponding to an inclination angle of the operating lever. The controller may: at a non-special time when a turning deceleration operation is performed not concurrently with an arm operation, feed command currents to one of the first solenoid proportional valves and one of the second solenoid proportional valves, respectively, the command currents each corresponding to the operation signal outputted from the arm operation device; and at a special time when the turning deceleration operation is performed concurrently with the arm operation, set the command current fed to the one first solenoid proportional valve to zero, and feed a special command current to the one second solenoid proportional valve, the special command current corresponding to the operation signal outputted from the arm operation device and being a result of multiplying, by predetermined times, the command current that is fed to the one second solenoid proportional valve at the non-special time. According to this configuration, also in a case where a turning deceleration operation is performed concurrently with an arm operation, the advantage that energy consumption can be reduced can be obtained.

The pair of make-up lines, the tank line connecting the turning control valve to the tank, the tank line connecting the arm first control valve to the tank, and the tank line connecting the arm second control valve to the tank may merge together to form a single shared line that connects to the tank, and the shared line may be provided with a spring-equipped check valve. According to this configuration, since the pressure of each make-up line is kept higher than or equal to the cracking pressure of the spring-equipped check valve, the supply of the hydraulic oil to the turning motor through the make-up line is performed smoothly.

Advantageous Effects of Invention

The present invention makes it possible to reduce energy consumption at the time of gradual turning deceleration.

DESCRIPTION OF EMBODIMENTS

Embodiment 1

Figure 1:
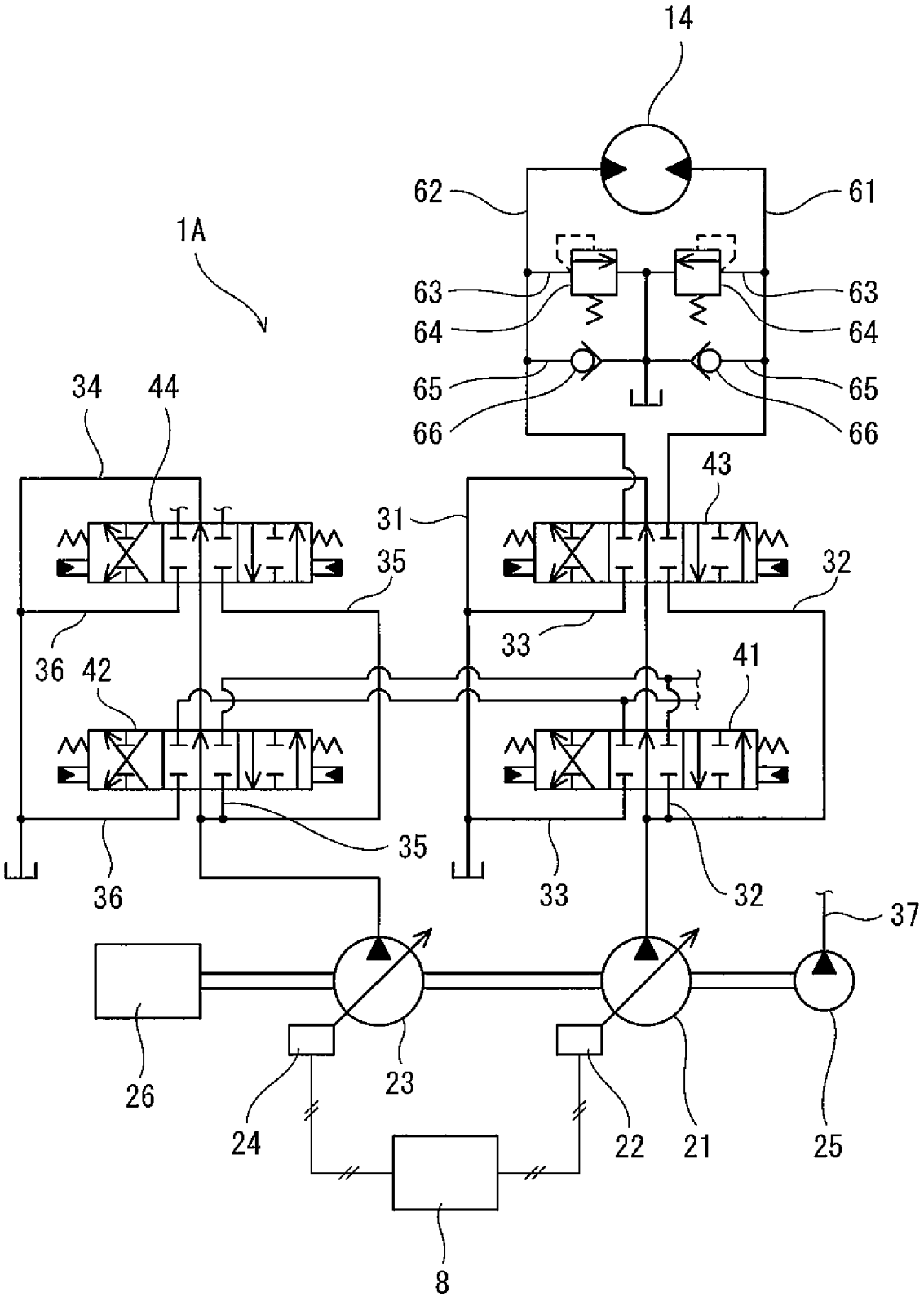
FIG. 1 is a main circuit diagram of a hydraulic drive system according to Embodiment 1 of the present invention.
Figure 2:
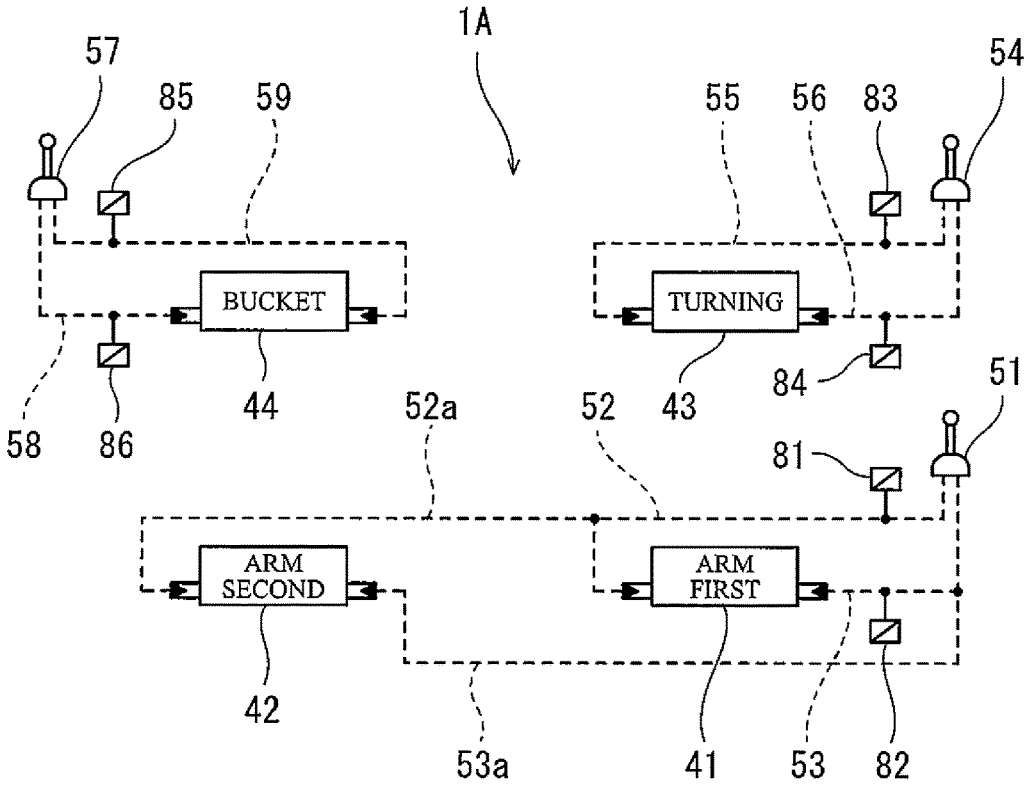
FIG. 2 is an operation-related circuit diagram of the hydraulic drive system according to Embodiment 1.
Figure 3:
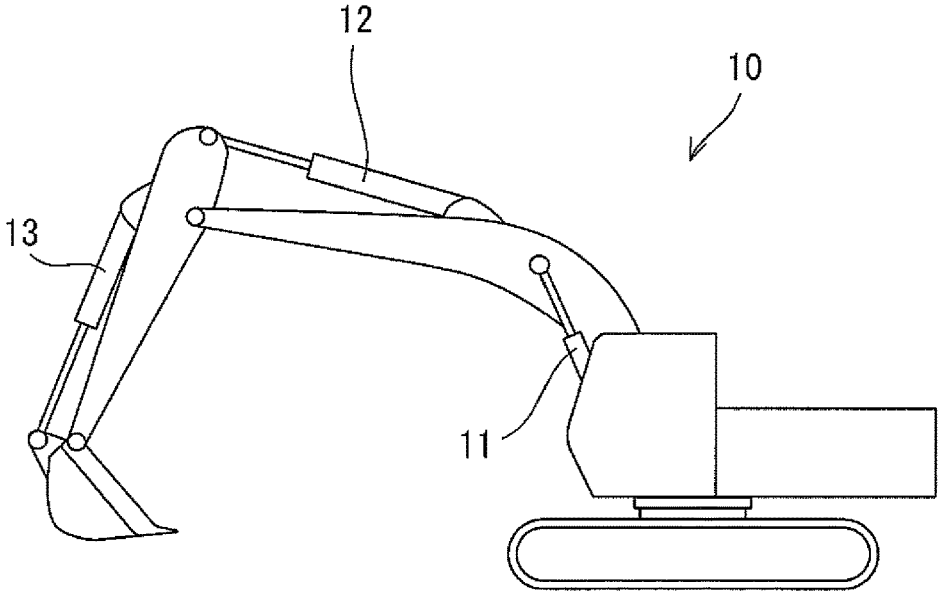
FIG. 3 is a side view of a hydraulic excavator that is one example of a construction machine.

FIG. 1 and FIG. 2 show a hydraulic drive system 1A of a construction machine according to Embodiment 1 of the present invention. FIG. 3 shows a construction machine 10, in which the hydraulic drive system 1A is installed. Although the construction machine 10 shown in FIG. 3 is a hydraulic excavator, the present invention is applicable to other construction machines, such as a hydraulic crane.

The hydraulic drive system 1A includes the following hydraulic actuators: a boom cylinder 11, an arm cylinder 12, and a bucket cylinder 13, which are shown in FIG. 3; a turning motor 14 shown in FIG. 1; and a pair of right and left running motors, which is not shown. As shown in FIG. 1, the hydraulic drive system 1A further includes a first main pump 21 and a second main pump 23 for supplying hydraulic oil to these actuators. It should be noted that, in FIG. 1, the actuators other than the turning motor 14 are not shown for the purpose of simplifying the drawing.

The first main pump 21 and the second main pump 23 are driven by an engine 26. The engine 26 also drives an auxiliary pump 25.

The first main pump 21 and the second main pump 23 are variable displacement pumps, each of which discharges the hydraulic oil at a flow rate corresponding to its tilting angle. In the present embodiment, the first main pump 21 and the second main pump 23 are each a swash plate pump, the tilting angle of which is defined by a swash plate angle. However, as an alternative, the first main pump 21 and the second main pump 23 may each be a bent axis pump, the tilting angle of which is defined by an angle formed by a drive shaft and a cylinder block.

The discharge flow rate Q1 of the first main pump 21 and the discharge flow rate Q2 of the second main pump 23 are controlled by electrical positive control. To be specific, the tilting angle of the first main pump 21 is adjusted by a first flow rate adjuster 22, and the tilting angle of the second main pump 23 is adjusted by a second flow rate adjuster 24. The first flow rate adjuster 22 and the second flow rate adjuster 24 will be described in detail below.

A first center bleed line 31 extends from the first main pump 21 to a tank. A plurality of control valves including an arm first control valve 41 and a turning control valve 43 are disposed on the first center bleed line 31 (the other control valves than the arm first control valve 41 and the turning control valve 43 are not shown on the first center bleed line 31). Each of the plurality of control valves is connected to the first main pump 21 by a pump line 32. That is, the control valves on the first center bleed line 31 are connected to the first main pump 21 in parallel. Also, each of these control valves is connected to the tank by a tank line 33.

Similarly, a second center bleed line 34 extends from the second main pump 23 to the tank. A plurality of control valves including an arm second control valve 42 and a bucket control valve 44 are disposed on the second center bleed line 34 (the other control valves than the arm second control valve 42 and the bucket control valve 44 are not shown on the second center bleed line 34). Each of the plurality of control valves is connected to the second main pump 23 by a pump line 35. That is, the control valves on the second center bleed line 34 are connected to the second main pump 23 in parallel. Also, each of these control valves is connected to the tank by a tank line 36.

The arm first control valve 41 controls, together with the arm second control valve 42, the supply and discharge of the hydraulic oil to and from the arm cylinder 12. That is, the hydraulic oil is supplied from the first main pump 21 to the arm cylinder 12 via the arm first control valve 41, and the hydraulic oil is supplied from the second main pump 23 to the arm cylinder 12 via the arm second control valve 42.

The turning control valve 43 controls the supply and discharge of the hydraulic oil to and from the turning motor 14. That is, the hydraulic oil is supplied from the first main pump 21 to the turning motor 14 via the turning control valve 43. To be specific, the turning motor 14 is connected to the turning control valve 43 by a pair of supply/discharge lines 61 and 62. Relief lines 63 branch off from the supply/discharge lines 61 and 62, respectively and the relief lines 63 connect to the tank. Each relief line 63 is provided with a relief valve 64. The supply/discharge lines 61 and 62 are connected to the tank by a pair of make-up lines 65, respectively. Each make-up line 65 is provided with a check valve 66, which allows a flow from the tank to the supply/discharge line (61 or 62) and blocks the reverse flow.

The bucket control valve 44 controls the supply and discharge of the hydraulic oil to and from the bucket cylinder 13. That is, the hydraulic oil is supplied from the second main pump 23 to the bucket cylinder 13 via the bucket control valve 44.

Although not illustrated, the control valves on the second center bleed line 34 include a boom first control valve, and the control valves on the first center bleed line 31 include a boom second control valve. The boom second control valve is a control valve dedicated for boom raising operation. That is, at the time of performing a boom raising operation, the hydraulic oil is supplied to the boom cylinder 11 via the boom first control valve and the boom second control valve, whereas at the time of performing a boom lowering operation, the hydraulic oil is supplied to the boom cylinder 11 only via the boom first control valve.

As shown in FIG. 2, the arm first control valve 41 and the arm second control valve 42 are operated by an arm operation device 51; the turning control valve 43 is operated by a turning operation device 54; and the bucket control valve 44 is operated by a bucket operation device 57. Each of the arm operation device 51, the turning operation device 54, and the bucket operation device 57 includes an operating lever, and outputs an operation signal corresponding to the inclination angle of the operating lever.

In the present embodiment, each of the arm operation device 51, the turning operation device 54, and the bucket operation device 57 is a pilot operation valve that outputs a pilot pressure corresponding to the inclination angle of the operating lever. Accordingly, the arm operation device 51 is connected to a pair of pilot ports of the arm first control valve 41 by a pair of pilot lines 52 and 53; the turning operation device 54 is connected to a pair of pilot ports of the turning control valve 43 by a pair of pilot lines 55 and 56; and the bucket operation device 57 is connected to a pair of pilot ports of the bucket control valve 44 by a pair of pilot lines 58 and 59. A pair of pilot ports of the arm second control valve 42 is connected to pilot lines 52 and 53 by a pair of pilot lines 52*a* and 53*a*. It should be noted that each of the operation devices may be an electrical joystick that outputs an electrical signal corresponding to the inclination angle of the operating lever, and a pair of solenoid proportional valves may be connected to the pilot ports of each control valve.

The pilot lines 52, 53, 55, 56, 58, and 59 are provided with pressure sensors 81 to 86, respectively, each of which detects a pilot pressure. It should be noted that the pressure sensors 81 and 82, each of which detects a pilot pressure outputted from the arm operation device 51, may be provided on the pilot lines 52*a* and 53*a*, respectively.

The first flow rate adjuster 22 and the second flow Late adjuster 24 are electrically controlled by a controller 8. For example, the controller 8 is a computer including a CPU and memories such as a ROM and a RAM. The CPU executes a program stored in the ROM. The controller 8 controls the first flow rate adjuster 22 and the second flow rate adjuster 24, such that the tilting angle of the first main pump 21 and/or the second main pump 23 increases in accordance with increase in the pilot pressures (operation signals) detected by the pressure sensors 81 to 86. For example, when a turning operation is performed alone, the controller 8 controls the first flow rate adjuster 22, such the tilting angle of the first main pump 21 increases in accordance with increase in the pilot pressure outputted from the turning operation device 54.

Figure 4:
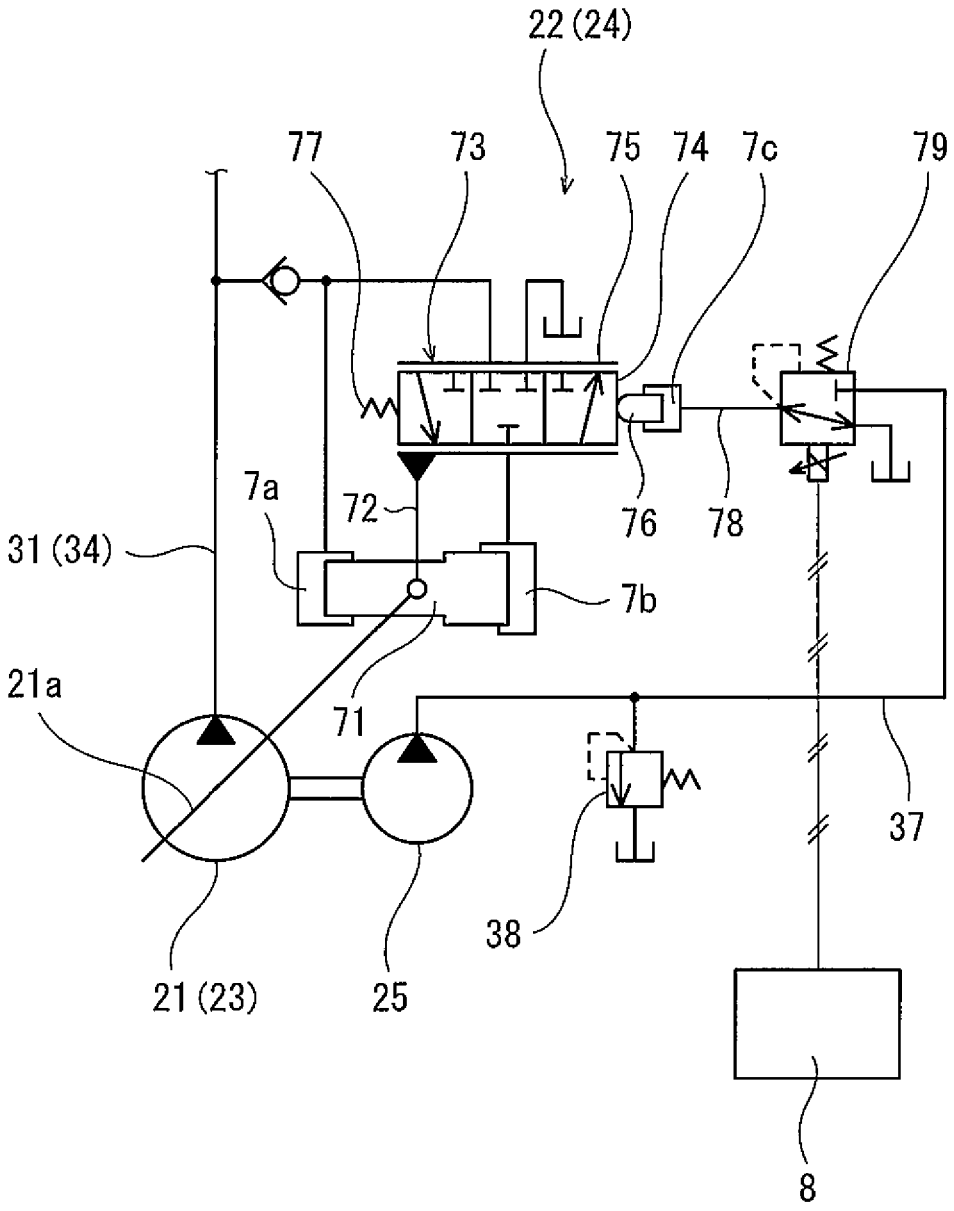
FIG. 4 shows a schematic configuration of a flow rate adjuster.

The first flow rate adjuster 22 and the second flow rate adjuster 24 have the same structure. Therefore, in the description below, the structure of the first flow rate adjuster 22 is described as a representative example with reference to FIG. 4.

The first flow rate adjuster 22 includes a servo piston 71 and an adjustment valve 73. The servo piston 71 changes the tilting angle of the first main pump 21, and the adjustment valve 73 is intended for driving the servo piston 71. In the first flow rate adjuster 22, a first pressure receiving chamber 7*a* and a second pressure receiving chamber 7*b* are formed. The discharge pressure Pd of the first main pump 21 is led into the first pressure receiving chamber 7*a*, and a control pressure Pc is led into the second pressure receiving chamber 7*b*. The servo piston 71 includes a first end portion and a second end portion. The second end portion has a greater diameter than that of the first end portion. The first end portion is exposed in the first pressure receiving chamber 7*a*, and the second end portion is exposed in the second pressure receiving chamber 7*b*.

The adjustment valve 73 is intended for adjusting the control pressure Pc led into the second pressure receiving chamber 7*b*. To be specific, the adjustment valve 73 includes a spool 74 and a sleeve 75. The spool 74 moves in a direction to increase the control pressure Pc (in FIG. 4, to the right), and also moves in a direction to decrease the control pressure Pc (in FIG. 1, to the left). The sleeve 75 accommodates the spool 74.

The servo piston 71 is coupled to a swash plate 21*a* of the first main pump 21, such that the servo piston 71 is movable in its axial direction. The sleeve 75 is coupled to the servo piston 71 by a feedback lever 72, such that the sleeve 75 is movable in the axial direction of the servo piston 71. In the sleeve 75, a pump port, a tank port, and an output port are formed (the output port communicates with the second pressure receiving chamber 7*b*). The output port is blocked from the pump port and the tank port, or communicates with the pump port or the tank port, in accordance with the positions of the sleeve 75 and the spool 74 relative to each other. Depending on the specifications, the output port may communicate with both the pump port and the tank port. When a flow rate adjusting piston 76, which will be described below, moves the spool 74 in the direction to increase the control pressure Pc or in the direction to decrease the control pressure Pc, the spool 74 and the sleeve 75 are brought to positions relative to each other such that forces applied from both sides of the servo piston 71 (each force=pressure×pressure receiving area of the servo piston) are balanced, and thereby the control pressure Pc is adjusted. When the control pressure Pc increases, the servo piston 71 moves to the left in FIG. 4, and the angle of the swash plate 21*a* (the tilting angle of the first main pump 21) decreases. Consequently, the discharge flow rate Q1 of the first main pump 21 decreases. When the control pressure Pc decreases, the servo piston 71 moves to the right in FIG. 4, and the angle of the swash plate 21*a* increases. Consequently, the discharge flow rate Q1 of the first main pump 21 increases.

The first flow rate adjuster 22 includes the flow rate adjusting piston 76 and a spring 77. The flow rate adjusting piston 76 is intended for driving the spool 74. The spring 77 is disposed opposite to the flow rate adjusting piston 76, with the spool 74 being positioned between the spring 77 and the flow rate adjusting piston 76. The spool 74 is pressed by the flow rate adjusting piston 76 to move in the direction to decrease the control pressure Pc (i.e., in a flow rate increasing direction), and is moved by the urging force of the spring 77 in the direction to increase the control pressure Pc (i.e., in a flow rate decreasing direction).

Further, an actuating chamber 7*c*, which applies a signal pressure Pp to the flow rate adjusting piston 76, is formed in the first flow rate adjuster 22. The higher the signal pressure Pp, the more the flow rate adjusting piston 76 moves the spool 74 in the direction to decrease the control pressure Pc (i.e., in the flow rate increasing direction). In other words, the flow rate adjusting piston 76 operates the servo piston 71 via the spool 74, such that the tilting angle of the first main pump 21 increases in accordance with increase in the signal pressure Pp.

The first flow rate adjuster 22 further includes a solenoid proportional valve 79, which is connected to the actuating chamber 7*c* by a signal pressure line 78. The solenoid proportional valve 79 is connected to the aforementioned auxiliary pump 25 by a primary pressure line 37. A relief line branches off from the primary pressure line 37, and the relief line is provided with a relief valve 38.

The solenoid proportional valve 79 is fed with a command current I from the controller 8. The solenoid proportional valve 79 is a direct proportional valve whose secondary pressure increases in accordance with increase in the command current I, and outputs the secondary pressure, which corresponds to the command current I, as the aforementioned signal pressure Pp.

Next, the control of the first flow rate adjuster 22 performed by the controller 8 is described in detail (the description of the control of the second flow rate adjuster 24 is omitted herein).

The command current I fed from the controller 8 to the solenoid proportional valve 79 of the first flow rate adjuster 22 varies depending on whether a turning operation, an arm operation, or the like is performed alone or concurrently with another operation. Hereinafter, as one example, a case where a turning operation is performed alone is described.

Figure 6:
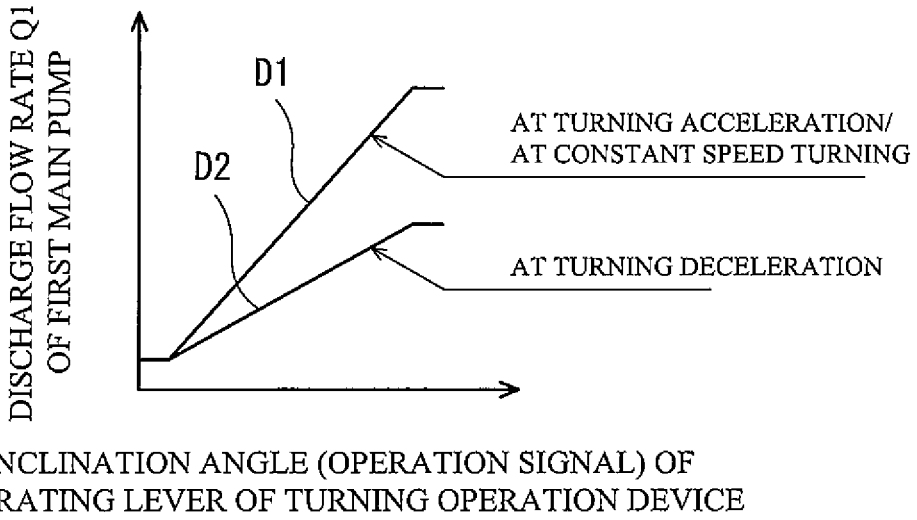
FIG. 6 is a graph showing a relationship between the inclination angle of the operating lever of the turning operation device and the discharge flow rate of a main pump in a case where a turning operation is performed alone.

In a case where a turning operation is performed alone, as shown in FIG. 6, when the pilot pressure (operation signal) outputted from the turning operation device 54 increases (i.e., at the time of turning acceleration) and when the pilot pressure outputted from the turning operation device 54 is constant (i.e., at the time of constant speed turning), the controller 8 controls the first flow rate adjuster 22, such that the discharge flow rate Q1 of the first main pump 21 changes on a first regulation line D1. On the other hand, when the pilot pressure outputted from the turning operation device 54 decreases (i.e., at the time of turning deceleration), the controller 8 controls the first flow rate adjuster 22, such that the discharge flow rate Q1 of the first main pump 21 changes on a second regulation line D2. The second regulation line D2 has a slope less than the slope of the first regulation line D1.

Figure 5:
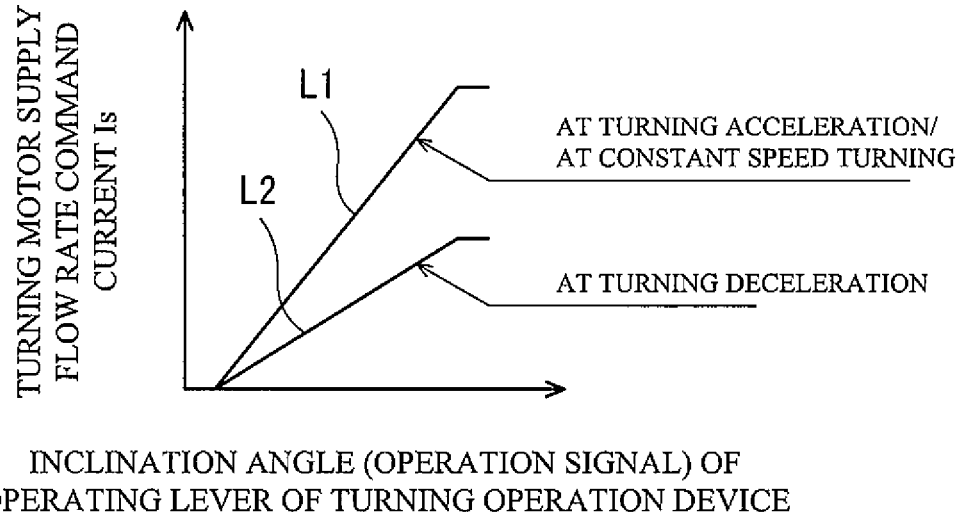
FIG. 5 is a graph showing a first sloped line and a second sloped line that are relationship lines each indicating a relationship between the inclination angle of an operating lever of a turning operation device (i.e., an operation signal outputted from the turning operation device) and a turning motor supply flow rate command current.

To be specific, as shown in FIG. 5, the controller 8 stores a first sloped line L1 and a second sloped line L2 as relationship lines. The second sloped line L2 has a slope less than the slope of the first sloped line L1. These relationship lines each indicate a relationship between the pilot pressure (operation signal) outputted from the turning operation device 54 and a turning motor supply flow rate command current Is.

At the time of turning acceleration and at the time of constant speed turning, the controller 8 uses the first sloped line L1 to determine the turning motor supply flow rate command current Is. At the time of turning deceleration, the controller 8 uses the second sloped line L2 to determine the turning motor supply flow rate command current Is. That is, when the angle of the operating lever of the turning operation device 54 is reduced from a predetermined angle, the turning motor supply flow rate command current Is rapidly changes from a point on the first sloped line L1 to a point on the second sloped line L2.

In a case where a turning operation is performed alone, the command current I fed from the controller 8 to the solenoid proportional valve 79 is equal to the turning motor supply flow rate command current Is (I=Is). It should be noted that in a case where a turning operation is performed concurrently with an arm operation, the command current I is the sum of the turning motor supply flow rate command current Is and an arm cylinder supply flow rate command current Ia (I=Is+Ia).

The above-described determination of the turning motor supply flow rate command current Is at the time of turning deceleration, in which the second sloped line L2 is used, is performed not only in a case where a turning operation is performed alone, but also, at least, either in a case where a turning deceleration operation is performed concurrently with a boom lowering operation or in a case where a turning deceleration operation is performed concurrently with a bucket operation (a bucket-in operation or a bucket-out operation). In other cases, even at the time of turning deceleration, the first sloped line L1 is used to determine the turning motor supply flow rate command current Is.

As described above, in the hydraulic drive system 1A of the present embodiment, the discharge flow rate Q1 of the first main pump 21 is kept low at the time of turning deceleration, including at the time of gradual turning deceleration. Even when the discharge flow rate Q1 of the first main pump 21 is insufficient as a necessary flow rate for rotating the turning motor 14, the shortfall amount of hydraulic oil is supplied to the turning motor 14 through the make-up line 65. Thus, at the time of gradual turning deceleration, energy consumption can be reduced by an amount corresponding to the lowering of the discharge flow rate Q1 of the first main pump 21.

Figure 7:
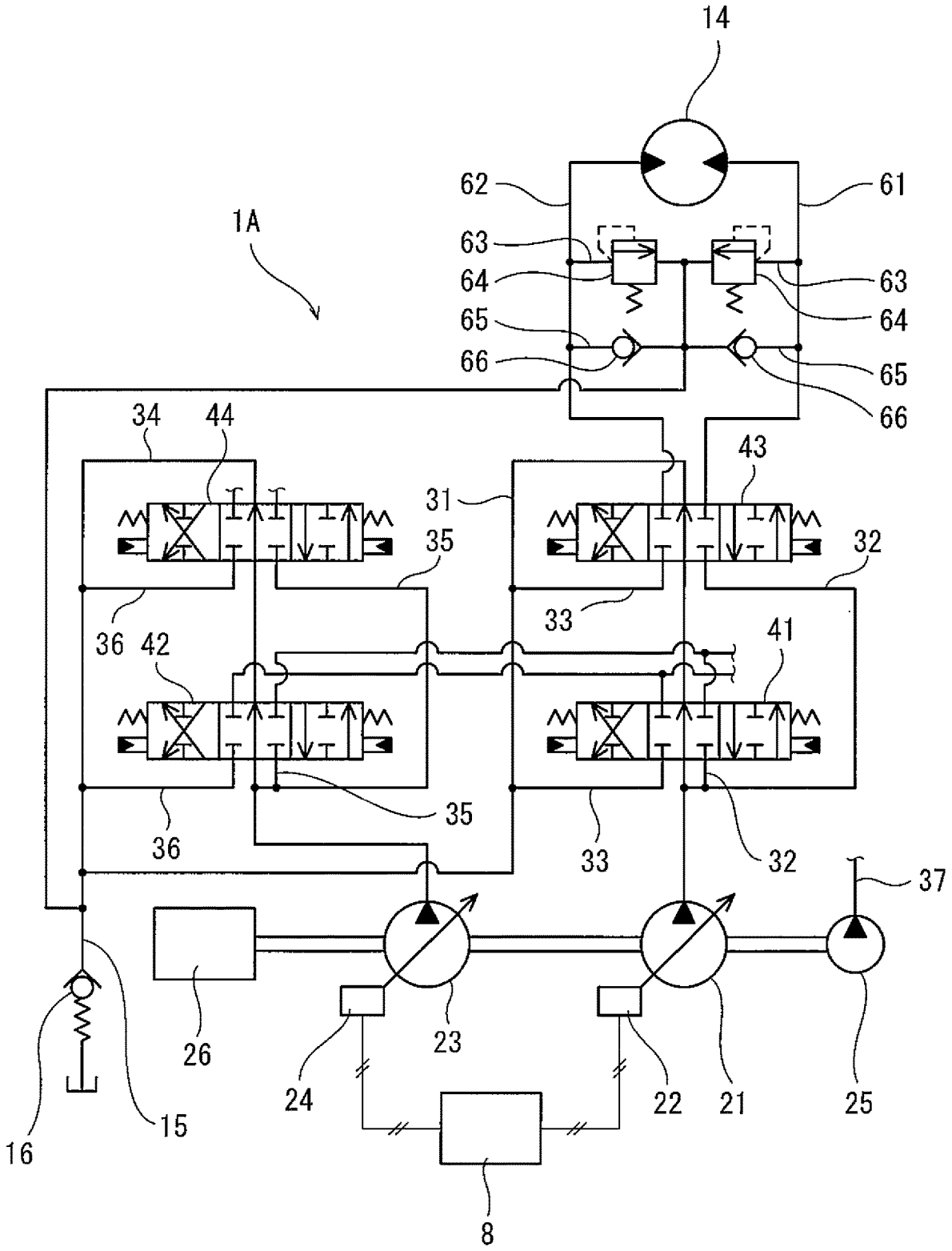
FIG. 7 is a main circuit diagram of the hydraulic drive system according to a variation.

As shown in FIG. 7, desirably, the pair of make-up lines 65 merges with all the tank lines 33 of the first main pump 21 side and all the tank lines 36 of the second main pump 23 side to form a single shared line 15, which connects to the tank. In the example shown in FIG. 7, the first center bleed line 31 and the second center bleed line 34 merge with the pair of make-up lines 65 to form the single shared line 15. More desirably, the shared line 15 is provided with a spring-equipped check valve 16, which allows a flow toward the tank and blocks the reverse flow. According to such a configuration, since the pressure of each make-up line 65 is kept higher than or equal to the cracking pressure of the spring-equipped check valve 16, the supply of the hydraulic oil to the turning motor 14 through the make-up line 65 is performed smoothly.

Embodiment 2

Figure 8:
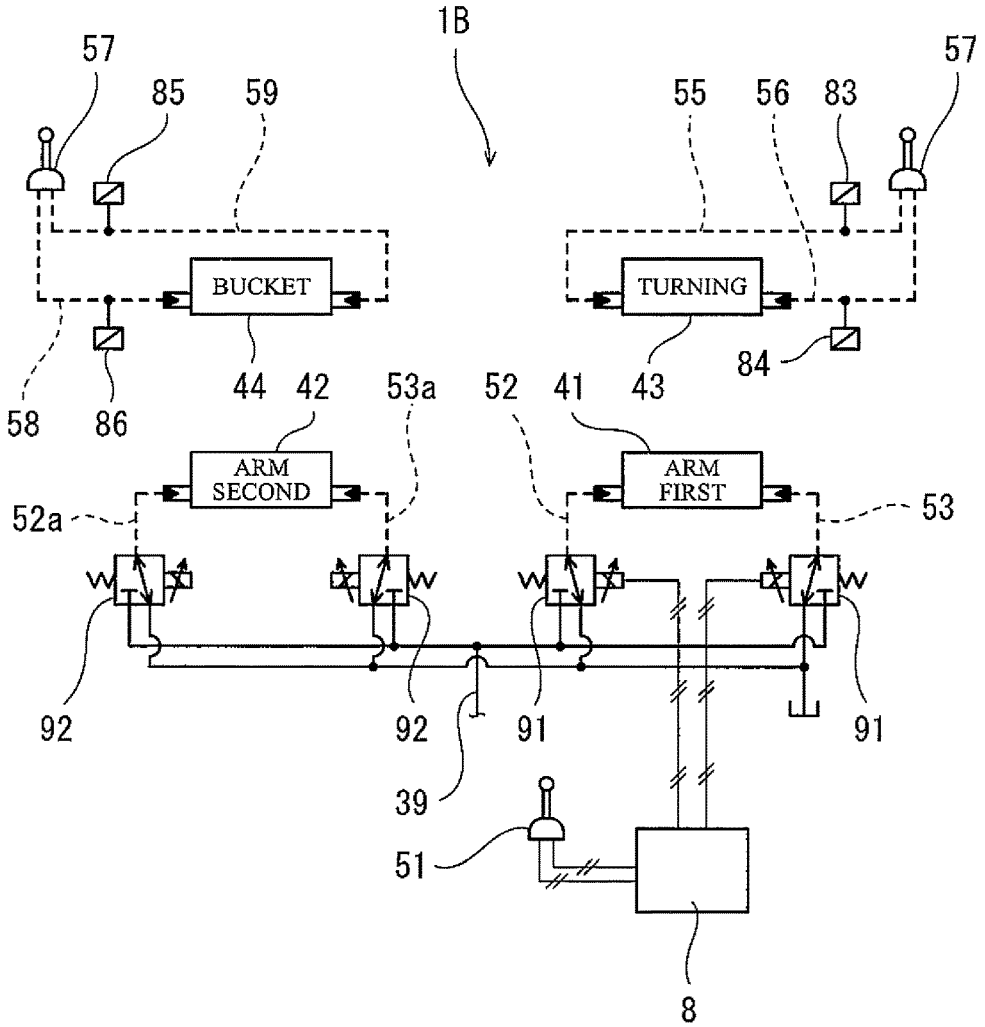
FIG. 8 is an operation-related circuit diagram of a hydraulic drive system according to Embodiment 2 of the present invention.

FIG. 8 shows a hydraulic drive system 1B of a construction machine according to Embodiment 2 of the present invention. It should be noted that, in the present embodiment, the same components as these described in Embodiment 1 are denoted by the same reference signs as those used in Embodiment 1, and repeating the same descriptions is avoided.

The main circuit of the hydraulic drive system 1B of the present embodiment is the same as the main circuit of the hydraulic drive system 1A of Embodiment 1 shown in FIG. 1. The only difference of the hydraulic drive system 1B from the hydraulic drive system 1A is that the arm operation device 51 is an electrical joystick. That is, the arm operation device 51 outputs an electrical signal (operation signal) corresponding to the inclination angle of the operating lever directly to the controller 8. Accordingly, the pair of pilot ports of the arm first control valve 41 is connected to a pair of first solenoid proportional valves 91 by the pilot lines 52 and 53, and the pair of pilot ports of the arm second control valve 42 is connected to a pair of second solenoid proportional valves 92 by the pilot lines 52*a* and 53*a*. The first solenoid proportional valves 91 and the second solenoid proportional valves 92 are connected to the auxiliary pump 25 (see FIG. 1) by a primary pressure line 39.

In the present embodiment, in a case where a turning operation is performed alone, in a case where a turning deceleration operation is performed concurrently with a boom lowering operation, and in a case where a turning deceleration operation is performed concurrently with a bucket operation, similar to Embodiment 1, the controller 8 determines the turning motor supply flow rate command current Is by using the second sloped line L2 at the time of turning deceleration. Further, in the present embodiment, also in a case where a turning deceleration operation is performed concurrently with an arm operation (an arm crowding operation or an arm pushing operation), the controller 8 determines the turning motor supply flow rate command current Is by using the second sloped line L2 at the time of turning deceleration.

Figure 9A:
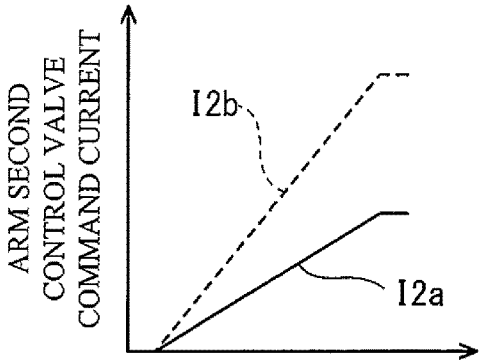
FIG. 9A is a graph showing a relationship between the inclination angle of an operating lever of an arm operation device (i.e., an operation signal outputted from the arm operation device) and an arm second control valve command current.
Figure 9B:
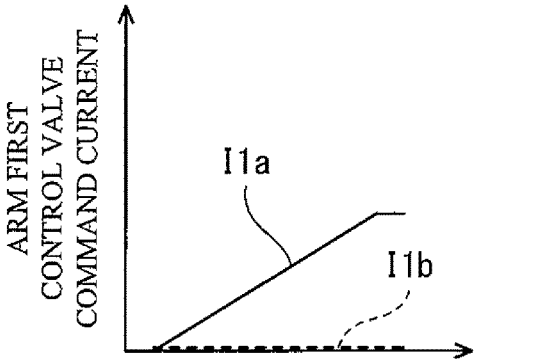
FIG. 9B is a graph showing a relationship between the inclination angle of the operating lever of the arm operation device and an arm first control valve command current.

To be specific, at a non-special time, i.e., at a time when a turning deceleration operation is performed not concurrently with an arm operation, as indicated by solid line in FIGS. 9A and 9B, the controller 8 feeds a command current I1*a* and a command current I2*a* to one of the first solenoid proportional valves 91 and one of the second solenoid proportional valves 92, respectively, the command currents I1*a* and I2*a* each corresponding to the electrical signal (operation signal) outputted from the arm operation device 51. It should be noted that examples of the non-special time include; a time when an arm operation is performed alone; a time when an arm operation and a boom lowering operation are performed concurrently; and a time when an arm operation and a bucket operation are performed concurrently.

On the other hand, at a special time, i.e., at a time when a turning deceleration operation is performed concurrently with an arm operation, as indicated by dashed line in FIG. 9B, the controller 8 sets a command current I1*b* fed to the one first solenoid proportional valve 91 to zero, and also, as indicated by dashed line in FIG. 9A, the controller 8 feeds a special command current 2*b* to the one second solenoid proportional valve 92. The special command current I2*b* corresponds to the electrical signal outputted from the arm operation device 51, and is a result of multiplying, by predetermined times, the command current I2*a*, which is fed to the one second solenoid proportional valve 92 at the non-special time. It should be noted that examples of the special time include: a time when an arm operation and a turning deceleration operation are performed concurrently; and a time when low-load work, such as a boom lowering operation or a bucket operation, is performed in addition to such concurrently performed operations. The "predetermined times" means a number of times of multiplication that brings the opening area of the arm second control valve 42 at a special time to be equal to the sum of the opening area of the arm first control valve 41 and the opening area of the arm second control valve 42 at a non-special time.

Figure 10A:
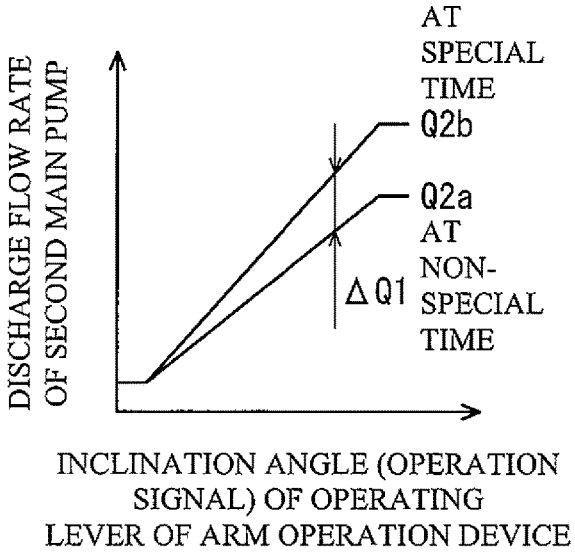
FIG. 10A is a graph showing a relationship between the inclination angle of the operating lever of the arm operation device and the discharge flow rate of a second main pump.
Figure 10B:
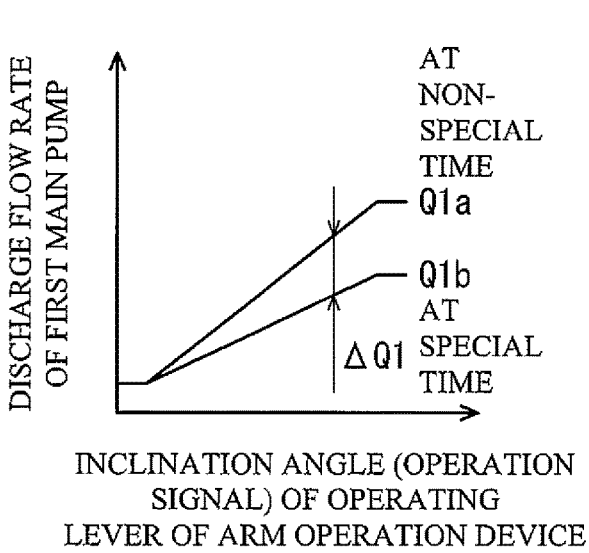
FIG. 10B is a graph showing a relationship between the inclination angle of the operating lever of the arm operation device and the discharge flow rate of a first main pump.

It should be noted that, as shown in FIG. 10A the discharge flow rate Q2*b* of the second main pump 23 at a special time is higher than the discharge flow rate Q2*a* of the second main pump 23 at a non-special time by a flow rate ΔQ1, which is supplied from the first main pump 21 to the arm first control valve 41 at a non-special time. Also, as shown in FIG. 10B, the discharge flow rate Q1*b* of the first main pump 21 at a special time is lower than the discharge flow rate Q1*a* of the first main pump 21 at a non-special time as described in Embodiment 1.

In the present embodiment, not only in the same case as that described in Embodiment 1, but also in a case where a combined operation is performed, i.e., a case where a turning deceleration operation is performed concurrently with an arm operation, the advantage that energy consumption is reduced can be obtained. In addition, although the energy consumption is reduced, the flow rate flowing into the arm cylinder 12 does not change. For this reason, operation feeling when performing the combined operation is not negatively affected. In other words, an advantage that the speed of the arm cylinder 12 is not lowered can also be obtained.

Other Embodiments

The present invention is not limited to the above-described Embodiments 1 and 2. Various modifications can be made without departing from the spirit of the present invention.

Figure 11:
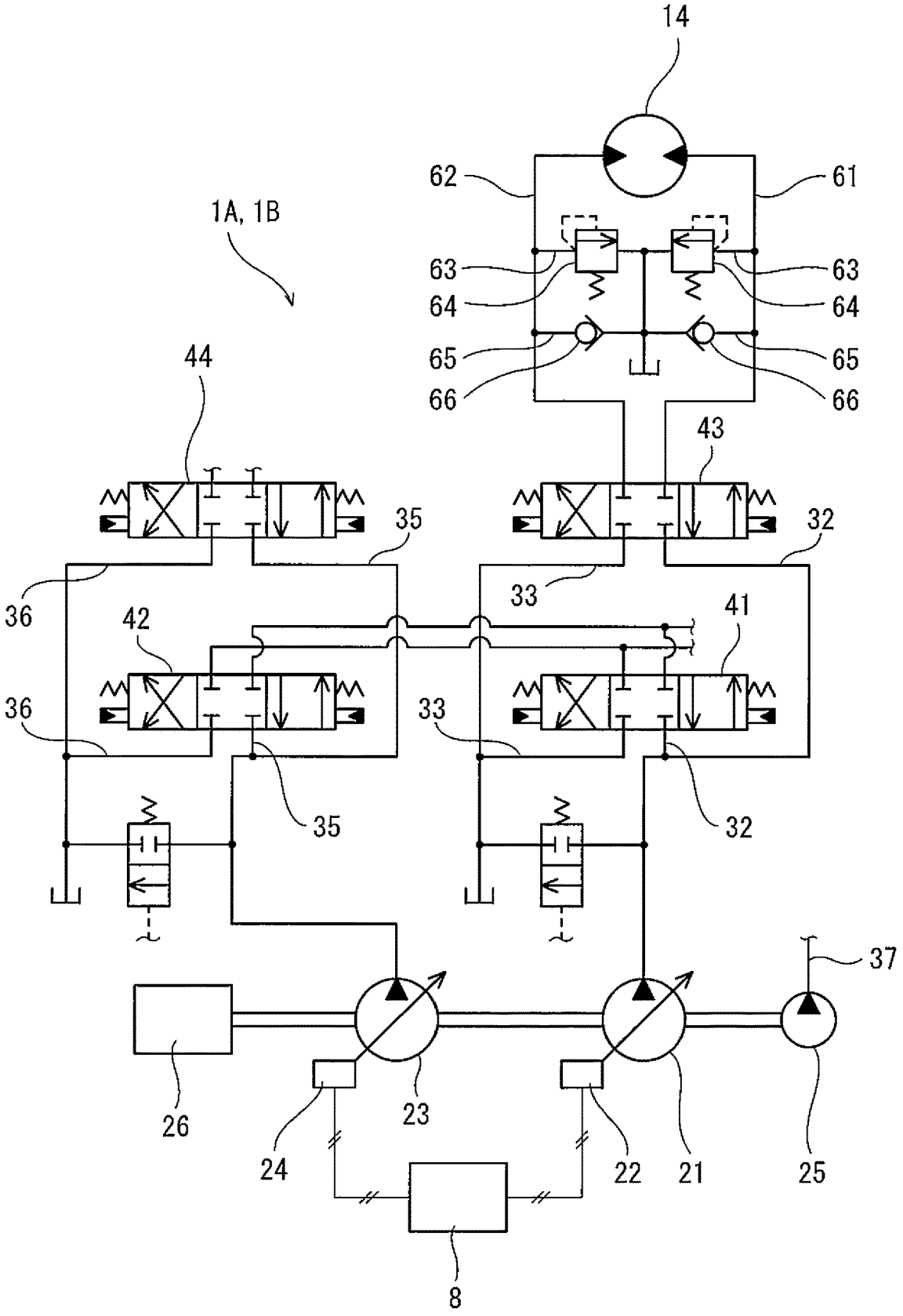
FIG. 11 is a main circuit diagram of the hydraulic drive system according to another variation.

For example, depending on the type of the construction machine, the second main pump 23 can be eliminated. Also, as shown in FIG. 11, the first center bleed line 31 and the second center bleed line 34 may be eliminated in Embodiment 1 and Embodiment 2.

REFERENCE SIGNS LIST

1A, 1B hydraulic drive system
10 construction machine
12 arm cylinder
14 turning motor
15 shared line
16 spring-equipped check valve
21 first main pump
22 first flow rate adjuster
23 second main pump
24 second flow rate adjuster
32, 35 pump line
33, 36 tank line
41 arm first control valve
42 arm second control valve
43 turning control valve
51 arm operation device
54 turning operation device
61, 62 supply/discharge line
65 make-up line
66 check valve
71 servo piston
74 spool
76 flow rate adjusting piston
79 solenoid proportional valve
8 controller
91 first solenoid proportional valve
92 second solenoid proportional valve

The invention claimed is:

1. A hydraulic drive system of a construction machine, comprising:
a variable displacement pump that supplies hydraulic oil to a turning motor via a turning control valve;
a pair of supply/discharge lines that connect the turning motor and the turning control valve;
a pair of make-up lines that connect the pair of supply/discharge lines to a tank, respectively, each make-up line being provided with a check valve that allows a flow from the tank to a corresponding one of the supply/discharge lines and blocks a reverse flow;
a turning operation device including an operating lever and outputting an operation signal corresponding to an inclination angle of the operating lever;
a flow rate adjuster that adjusts a tilting angle of the pump; and
a controller that controls the flow rate adjuster, such that the tilting angle of the pump increases in accordance with increase in the operation signal outputted from the turning operation device, wherein
the controller:
when the operation signal outputted from the turning operation device increases and when the operation signal outputted from the turning operation device is constant, controls the flow rate adjuster such that a discharge flow rate of the pump changes on a first regulation line; and
when the operation signal outputted from the turning operation device decreases, controls the flow rate adjuster such that the discharge flow rate of the pump changes on a second regulation line, the second regulation line having a slope less than a slope of the first regulation line.

2. The hydraulic drive system of a construction machine according to claim 1, wherein
the flow rate adjuster includes:
a flow rate adjusting piston that operates a servo piston via a spool, such that the tilting angle of the pump increases in accordance with increase in a signal pressure; and
a solenoid proportional valve of a direct proportional type, the solenoid proportional valve being fed with a command current from the controller and outputting a secondary pressure as the signal pressure,
the controller stores a first sloped line and a second sloped line as relationship lines, the second sloped line having a slope less than a slope of the first sloped line, the relationship lines each indicating a relationship between the operation signal outputted from the turning operation device and the command current, and
the controller:
when the operation signal outputted from the turning operation device increases and when the operation signal outputted from the turning operation device is constant, determines the command current by using the first sloped line; and
when the operation signal outputted from the turning operation device decreases, determines the command current by using the second sloped line.

3. The hydraulic drive system of a construction machine according to claim 2, wherein
the construction machine is a hydraulic excavator,
the pump is a first pump,
the turning control valve is connected to the first pump by a pump line and connected to the tank by a tank line,
the hydraulic drive system further comprises:
an arm first control valve connected to the first pump by a pump line and connected to the tank by a tank line;
a second pump that is a variable displacement pump;
an arm second control valve connected to the second pump by a pump line and connected to the tank by a tank line;
a pair of first solenoid proportional valves connected to a pair of pilot ports of the arm first control valve;
a pair of second solenoid proportional valves connected to a pair of pilot ports of the arm second control valve; and
an arm operation device including an operating lever and outputting an operation signal corresponding to an inclination angle of the operating lever, and
the controller:
at a non-special time when a turning deceleration operation is performed not concurrently with an arm operation, feeds command currents to one of the first solenoid proportional valves and one of the second solenoid proportional valves, respectively, the command currents each corresponding to the operation signal outputted from the arm operation device; and
at a special time when the turning deceleration operation is performed concurrently with the arm operation, sets the command current fed to the one first solenoid proportional valve to zero, and feeds a special command current to the one second solenoid proportional valve, the special command current corresponding to the operation signal outputted from the arm operation device and being a result of multiplying, by predetermined times, the command current that is fed to the one second solenoid proportional valve at the non-special time.

4. The hydraulic drive system of a construction machine according to claim 1, wherein the construction machine is a hydraulic excavator, the pump is a first pump, the turning control valve is connected to the first pump by a pump line and connected to the tank by a tank line, the hydraulic drive system further comprises:

an arm first control valve connected to the first pump by a pump line and connected to the tank by a tank line;

a second pump that is a variable displacement pump;

an arm second control valve connected to the second pump by a pump line and connected to the tank by a tank line;

a pair of first solenoid proportional valves connected to a pair of pilot ports of the arm first control valve;

a pair of second solenoid proportional valves connected to a pair of pilot ports of the arm second control valve; and an arm operation device including an operating lever and outputting an operation signal corresponding to an inclination angle of the operating lever, and the controller:

at a non-special time when a turning deceleration operation is performed not concurrently with an arm operation, feeds command currents to one of the first solenoid proportional valves and one of the second solenoid proportional valves, respectively, the command currents each corresponding to the operation signal outputted from the arm operation device; and at a special time when the turning deceleration operation is performed concurrently with the arm operation, sets the command current fed to the one first solenoid proportional valve to zero, and feeds a special command current to the one second solenoid proportional valve, the special command current corresponding to the operation signal outputted from the arm operation device and being a result of multiplying, by predetermined times, the command current that is fed to the one second solenoid proportional valve at the non-special time.

5. The hydraulic drive system of a construction machine according to claim 4, wherein the pair of make-up lines, the tank line connecting the turning control valve to the tank, the tank line connecting the arm first control valve to the tank, and the tank line connecting the arm second control valve to the tank merge together to form a single shared line that connects to the tank, and the shared line is provided with a spring-equipped check valve.

* * * * *